United States Patent [19]

Ehrlich

[11] 4,340,016

[45] Jul. 20, 1982

[54] TWO-STROKE INTERNAL COMBUSTION ENGINE AND METHOD OF OPERATION THEREOF

[75] Inventor: Josef Ehrlich, Near Berkhempsted, England

[73] Assignee: Outboard Marine Corporation, Waukegan, Ill.

[21] Appl. No.: 184,487

[22] Filed: Sep. 5, 1980

[51] Int. Cl.[3] ..... F02B 33/04

[52] U.S. Cl. ..... 123/73 R; 123/73 A; 123/73 AA; 123/73 PP; 123/65 A; 123/65 P

[58] Field of Search ..... 123/73 R, 73 A, 73 PP, 123/73 AA, 74 R, 74 A, 65 A, 65 P

[56] References Cited

U.S. PATENT DOCUMENTS 4,067,302 1/1978 Ehrlich ..... 123/73 PP

*Primary Examiner*—Wendell E. Burns

*Attorney, Agent, or Firm*—Michael, Best & Friedrich

[57] ABSTRACT

An internal combustion engine comprises a combustion chamber and a piston movable relative to the combustion chamber between top dead center and bottom dead center positions. A fuel transfer passage introduces fuel-air mixture into the combustion chamber in response to piston movement. An auxiliary chamber is also provided which is communicable with the combustion chamber in response to piston movement shortly after the ignition of a fuel-air mixture, such that high pressure ignition gases enter the auxiliary chamber. The high pressure ignition gases thereafter flow back into the combustion chamber in response to piston movement before communication is established between the combustion chamber and the fuel transfer passage. The incoming flow of high pressure ignition gases serves to influence the normal scavenging streams. The auxiliary chamber can also function as an auxiliary transfer passage in response to piston movement to supplement the fuel transfer passage in supplying a new fuel-air mixture charge to the combustion chamber. In one embodiment, an air transfer passage is provided for introducing fresh air into low pressure regions in the cylinder to lend overall stability to the scavenging process.

11 Claims, 13 Drawing Figures

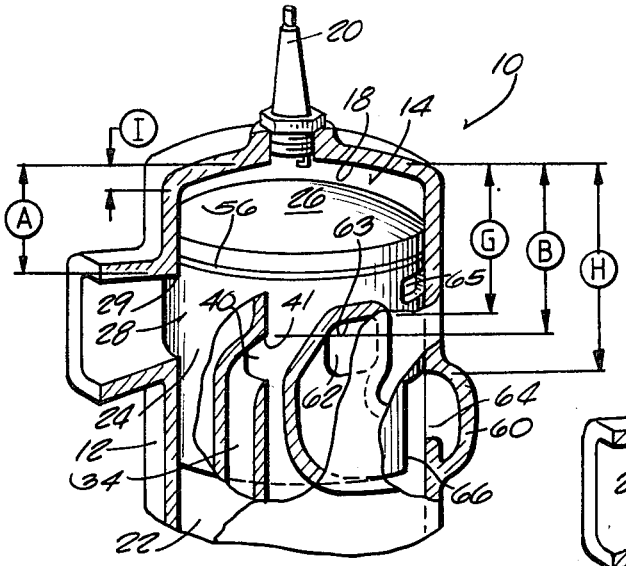
Fig. 8
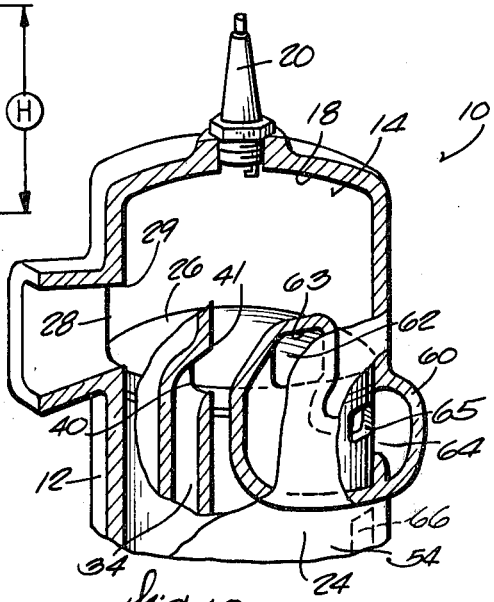
Fig. 10
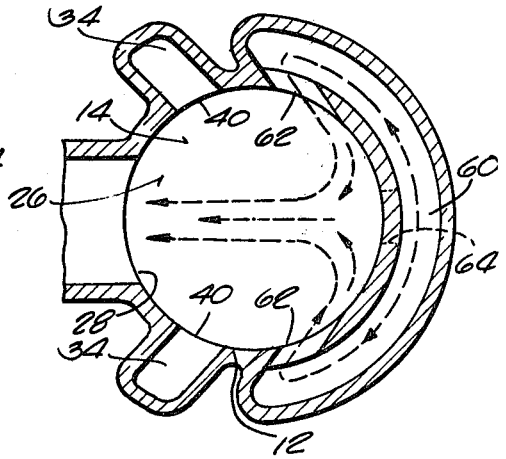
Fig. 11
Fig. 9
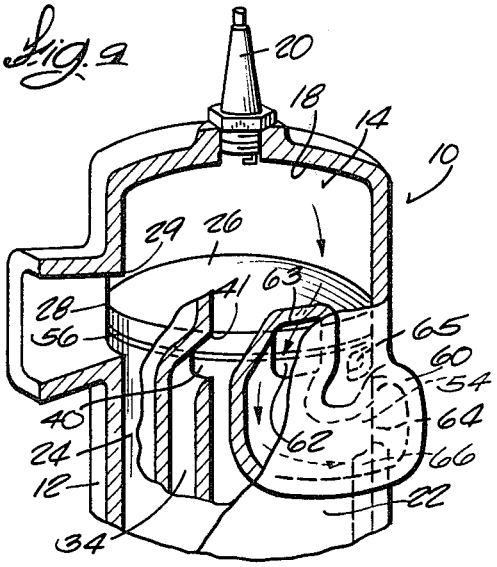

TWO-STROKE INTERNAL COMBUSTION ENGINE AND METHOD OF OPERATION THEREOF

FIELD OF THE INVENTION

The invention relates generally to internal combustion engines, and more particularly, to two-stroke, piston-ported engines.

DESCRIPTION OF THE PRIOR ART

Internal combustion engines commonly employ the incoming charge of fuel-air mixture to scavenge the exhaust gases from the cylinder. This can result in part of the incoming fuel-air charge being discharged unburnt into the atmosphere through the exhaust system. This not only can constitute a pollution problem, but it can also adversely affect fuel economy.

Attention is directed to the following United States patents which generally concern the scavenging of internal combustion engines:

| | | |
|---|---|---|
| Tenney | 3,612,014 | October 12,1971 |
| Kobayashi et al | 3,752,129 | August 14, 1973 |
| Hooper | 3,753,425 | August 21, 1973 |
| Tenney | 3,805,750 | April 23, 1974 |
| Dahlstrom | 3,799,130 | March 26, 1974 |
| Tenney | 3,815,558 | June 11, 1974 |
| Lanpheer | 3,858,562 | January 7, 1975 |
| Jaulmas | 3,881,454 | May 6, 1975 |
| Boyesen | 3,905,341 | September 16, 1975 |
| Boyesen | 4,000,723 | January 4, 1977 |
| Boyesen | 4,051,820 | October 4, 1977 |
| Boyesen | 4,062,331 | December 13, 1977 |
| Hale | 4,092,958 | June 6, 1978 |
| McWorter | 4,108,119 | August 22, 1978 |

Attention is also directed to my earlier U.S. Pat. Nos. 2,966,900 (issued Jan. 3, 1961), 3,312,205 (issued Apr. 4, 1967), 4,026,254 (issued May 31, 1977), and 4,067,302 (issued Jan. 10, 1978) which disclose other forms of prior two-stroke internal combustion engines.

SUMMARY OF THE INVENTION

The invention provides an internal combustion engine including a combustion chamber and an auxiliary chamber. A piston is movable relative to the combustion chamber between top dead center and bottom dead center positions. The piston is also movable relative to first, second, third, and fourth positions respectively spaced from the top dead center position at respectively greater distances. The engine further includes a source of pressurized fuel-air mixture, as well as a source of a pressurized gas. Means is provided for establishing communication between the auxiliary chamber and the source of pressurized gas during piston travel from the first to the second position. The pressurized gas is introduced into the auxiliary chamber during this time. Means are also provided for first isolating the pressurized gas introduced into the auxiliary chamber during piston travel from the second position to the third position, and then subsequently establishing communication between the auxiliary chamber and the combustion chamber during piston travel between the third position and the bottom dead center position. In this way, the pressurized gas previously supplied to the auxiliary chamber flows into the combustion chamber. Means is next provided for establishing communication between the combustion chamber and the pressurized fuel-air mixture during piston travel between the fourth piston and the bottom dead center position. The pressurized fuel-air mixture thus flows into the combustion chamber, and the previously established incoming stream of pressurized gas serves to influence the scavenging process.

In one embodiment, the engine also includes a source of low pressure as well as means for establishing communication between the auxiliary chamber and the source of low pressure during piston travel between the top dead center position and the first position. During this time, the auxiliary chamber is evacuated before being charged with the pressurized gas as just described.

In accordance with one embodiment, the engine includes a cylinder which forms the combustion chamber and a crankcase which extends from the cylinder. The crankcase is subject to cyclical conditions of high and low pressure in response to piston reciprocation. In this embodiment, the source of the pressurized gas comprises the cylinder, in which high pressure ignition gases exist shortly after ignition of the fuel-air mixture. Similarly, the source of low pressure comprises the crankcase.

The invention also provides an internal combustion engine including a cylinder and a crankcase which extends from the cylinder. A piston is movable relative to the cylinder between top dead center and bottom dead center positions and relative to first, second, third, fourth, and fifth positions respectively spaced from the top dead center position at respectively greater distances. The cylinder and crankcase are thus subject to cyclical conditions of relatively low and high pressure in response to piston reciprocation. Means is provided for supplying a fuel-air mixture to the crankcase when the crankcase is subject to low pressure. The engine further includes a first transfer passage communicable with both the cylinder and crankcase in response to piston travel. A second transfer passage is also provided which continuously communicates with the crankcase and is selectively communicable with the cylinder in response to piston travel. Means is provided for igniting the fuel-air mixture within the cylinder when the piston is located generally adjacent to the top dead center position. High pressure ignition gases are thereby created within the cylinder. Within this structural arrangement, means is provided for isolating the first transfer passage from the crankcase while establishing communication between the first transfer passage and the cylinder during piston travel from the first position to the second position and during the presence of high pressure ignition gases within the cylinder. The high pressure ignition gases are thereby introduced into the first transfer passage. Means is also provided for maintaining the isolation between the crankcase and the first transfer passage and the communication between the cylinder and the first transfer passage during piston travel from the second position to the third position and during conditions of low pressure in the cylinder. Thus, the high pressure ignition gases previously introduced into the first transfer passage now flow back into the cylinder. Furthermore, means is provided for establishing communication between the second transfer passage and the cylinder when the crankcase is subject to high pressure and during piston travel between the fourth position and the bottom dead center position. The fuel-air mixture thus flows from the crankcase into the cylinder through the second transfer passage and is influenced by the ongoing discharge of high pressure ignition gases. Finally, means is provided for establishing communication between the first transfer passage and the crankcase when the crankcase is subject to high pressure and during piston movement between the fifth position and the bottom dead center position. Thus, the fuel-air mixture flows from the crankcase into the cylinder through the first transfer passage in addition to the flow of fuel-air mixture into the cylinder through the second transfer passage. The flow of the incoming fuel-air mixture charge is thus supplemented.

In one embodiment, the engine further includes means for isolating the first transfer passage from the cylinder while establishing communication between the first transfer passage and the crankcase during piston travel between the top dead center position and the first position and during conditions of low pressure in the crankcase. In this way, the first transfer passage is evacuated before receiving the charge of high pressure ignition gases.

The invention further provides an internal combustion engine comprising a cylinder and a crankcase which extends from the cylinder. A piston is movable relative to the cylinder between top dead center and bottom dead center positions and relative to first and second positions respectively spaced from the top dead center position at respectively greater distances. Thus, the crankcase is subject to cyclical conditions of relatively high and low pressure. Means is provided for supplying a fuel-air mixture to the crankcase when the crankcase is subject to low pressure. A first transfer passage is provided which communicates with the crankcase and is communicable with the cylinder in response to piston movement. Means is provided for establishing communication between the first transfer passage and the cylinder during conditions of high pressure in the crankcase and during piston travel between the first position and the bottom dead center position, whereby an incoming flow of fuel-air mixture is established from the crankcase into the cylinder through the first transfer passage. A second transfer passage is also provided, along with means for selectively communicating the second transfer passage with the atmosphere when the second transfer passage is subject to low pressure so that fresh air can be introduced into the second transfer passage. Means is further provided for establishing communication between the second transfer passage and the cylinder during piston travel between the second position and the bottom dead center position, whereby fresh air is introduced through the second transfer passage into low pressure regions in the cylinder above the piston and below the incoming flow of fuel-air mixture. The overall stability of the scavenge loop is improved.

The invention further provides methods for operating the above described internal combustion engines.

One of the principal feature of the invention is the provision of an internal combustion engine and an associated method of operation thereof in which use is made of a pressurized gas, such as high pressure ignition gases, to influence both the removal of exhaust gases from the combustion chamber as well as the flow of a new fuel-air mixture charge into the combustion chamber. Increased fuel economy and a reduction in pollution are thereby obtained.

Another of the principal features of the invention is the provision of an internal combustion engine and an associated method of operation in which low pressure regions in the combustion chamber adversely affecting the stability of the scavenging loop are minimized by the selective introduction of fresh air.

Other features and advantages of the embodiments of the invention will become known by reference to the following general description, claims, and the appended drawings.

DESCRIPTION OF THE DRAWINGS

FIGS. 8, 9, and 10 are a series of perspective views, partially broken away, of a second embodiment of a scavenging system applicable for use in connection with the engine illustrated in FIG. 1 and which sequentially illustrate the operation of the second scavenging system embodiment;

FIG. 11 is a top sectional view of the second scavenging system embodiment shown in FIGS. 8, 9, and 10;

Figure 1:
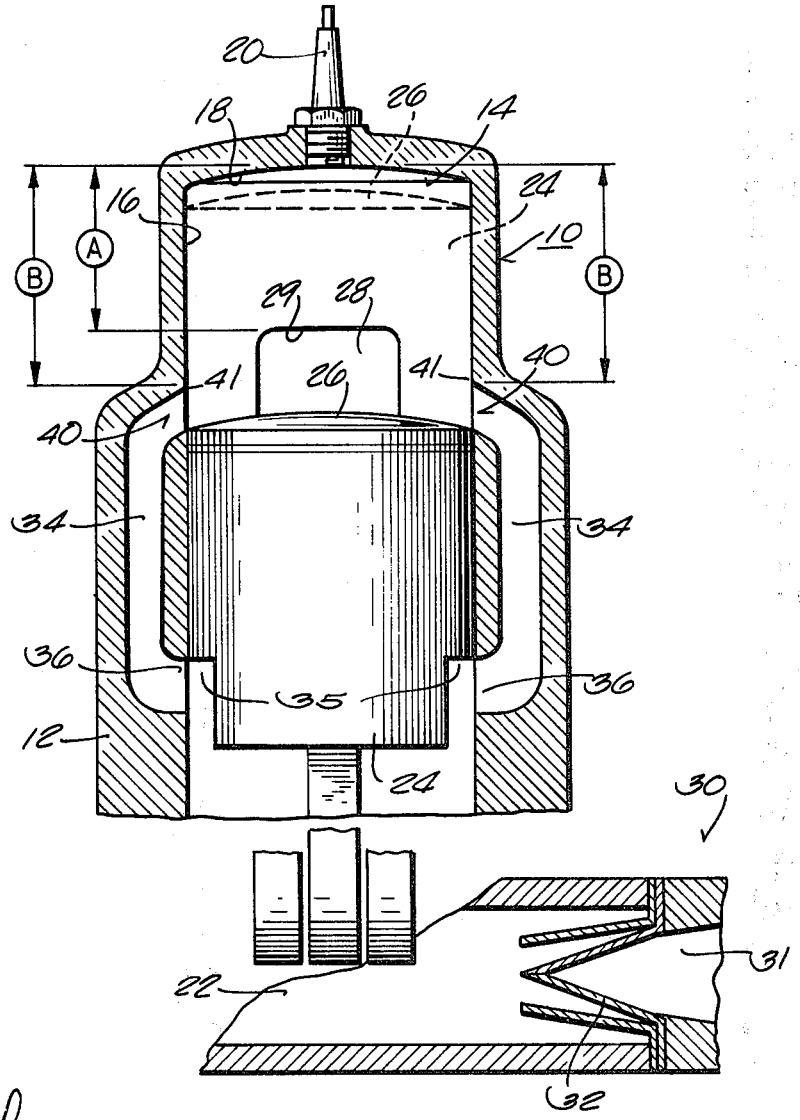
FIG. 1 is a side sectional view of an internal combustion engine which is illustrated with the piston in its bottom dead center position.

Before explaining the embodiments of the invention in detail, it is to be understood that the invention is not limited in its application and details of construction to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

An internal combustion engine 10 is shown in the drawings. As generally illustrated in FIG. 1, the engine 10 is a piston-ported two-stroke engine and includes a block 12 defining a combustion chamber 14 in the form of a cylinder 16 having a head end 18. A spark plug 20 is provided for igniting a fuel-air mixture in the combustion chamber 14.

Still referring principally to FIG. 1, a crankcase 22 extends from the combustion chamber 14. A piston 24 having a head end 26 is mounted in conventional fashion for reciprocal movement in the combustion chamber 14 and relative to the crankcase 22 between a top dead center position (shown in phantom lines in FIG. 1) and a bottom dead center position (shown in solid lines in FIG. 1). This reciprocal movement produces cyclical conditions of relatively high and low pressure in both the combustion chamber 14 and crankcase 22.

In accordance with the usual practice, the combustion chamber communicates with an exhaust port 28 which extends through the block 12. The exhaust port 28 includes an upper edge 29 spaced from the cylinder head end 18 at a distance A. The exhaust port 28 is thus opened as the piston 24 travels from its top dead center position toward its bottom dead center position, commencing when the piston head end 26 is located at the distance A from the cylinder head end 18.

To affect a flow of fuel-air mixture into the combustion chamber 14 prior to ignition, in accordance with the usual practice, a fuel-air mixture is first introduced into the crankcase 22 and thereafter transferred into the combustion chamber 14 in response to pressure variations occurring in the crankcase 22. In the illustrated construction (and as best shown in FIG. 1), a carburetor 30 is provided having an air induction passage 31 which communicates with the crankcase 22 through a reed valve assembly 32. During conditions of low pressure in the crankcase 22, which typically occur during the upstroke of the piston 24 toward its top dead center position, a fuel-air mixture is formed in the air induction passage 31 and drawn into the crankcase 22 through the reed valve assembly 32.

To next affect the flow of the fuel-air mixture from the crankcase 22 into the combustion chamber 14, the combustion chamber 14 and crankcase 22 are placed in communication with each other when the pressure in the crankcase 22 is at or near its maximum. Such communication is typically provided after opening of the exhaust port 28 during the downstroke of the piston 24 toward its bottom dead center position.

In the illustrated construction (and as best shown in FIG. 1), such communication is provided by one or more (two are illustrated) transfer passages 34 which extend in the engine block 12. Each transfer passage 34 includes a lower transfer port 36 which communicates with the crankcase 22. Correspondingly, the piston 24 includes, along its lower edge, notches 35 which provide continuous communication between each lower transfer port 36 and the crankcase 22.

Each transfer passage 34 also includes an upper transfer port 40 which communicates with the combustion chamber 14. Each upper transfer port 40 has an upper edge 41 spaced from the cylinder head end 18 at a distance B, which is greater than distance A. As a result, the upper transfer ports 40 are opened as the piston 24 travels toward its bottom dead center position, commencing when the piston head end 26 is located at the distance B from the cylinder head end 18. The fuel-air mixture thereafter flows through each transfer passage 34 from the crankcase 22 and into the combustion chamber 14.

Figure 12:
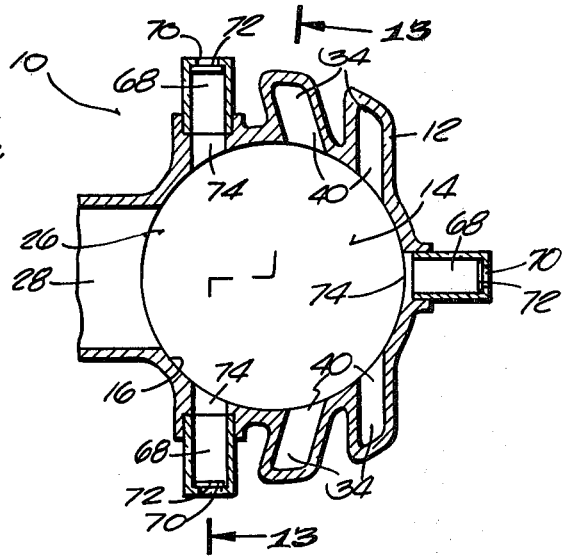
FIG. 12 is a top sectional view of a third embodiment of a scavenging system applicable for use in connection with the engine shown in FIG. 1.
Figure 13:
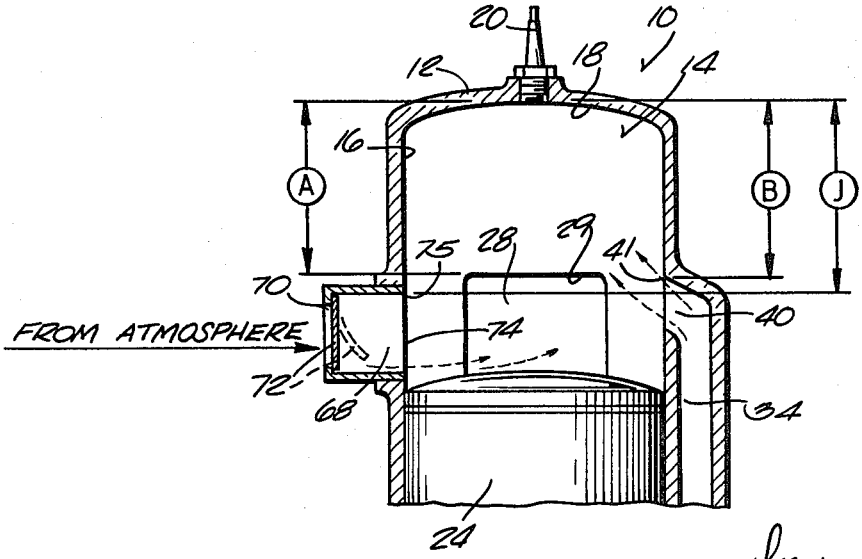
FIG. 13 is a side sectional view generally taken along line 13—13 in FIG. 12.

Various means are provided to minimize the loss of the fuel-air mixture through the exhaust port 28 during engine operation. As a result, the combustion chamber 14 is filled with a complete charge of fuel-air mixture when the exhaust port 28 closes prior to ignition of the fuel-air mixture by the spark plug 20. Three alternate embodiments are shown in the drawings. The first embodiment is illustrated in FIGS. 2 through 7. The second embodiment is illustrated in FIGS. 8 through 11. The third embodiment is shown in FIGS. 12 and 13. All three embodiments share the structural features shown in FIG. 1, to which features common reference numerals are assigned.

Reference is first made to the embodiment shown in FIGS. 2 through 7. In this embodiment, use is made of a pressurized gas to influence both the removal of exhaust gases from the combustion chamber 14 and the flow of a new fuel-air mixture charge into the combustion chamber 14. While any source of a pressurized gas may be used for this purpose, in the illustrated embodiment, the high pressure ignition gases formed in the combustion chamber 14 after ignition of the fuel-air mixture by the spark plug 20 are utilized. In accordance with the usual practice, such ignition of the fuel-air mixture occurs when the piston 24 is at or near its top dead center position.

Figure 7:
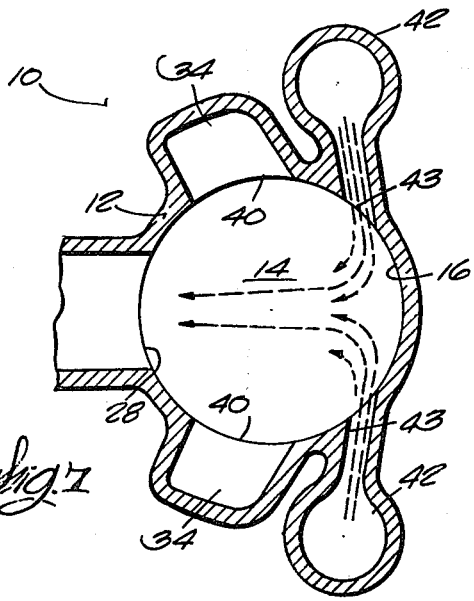
FIG. 7 is a top sectional view taken generally along line 7—7 in FIG. 5.

In this embodiment, the engine includes one or more auxiliary chambers 42. As is shown in FIG. 7, two such chambers are utilized in the illustrated construction. Means is provided for establishing communication between each of the auxiliary chambers 42 and the combustion chamber 14 after ignition but before the transfer passages 34 are opened. During this time, the auxiliary chambers 42 are charged with the high pressure ignition gases present in the combustion chamber 14. In the illustrated embodiment, communication is established between the auxillary chambers 42 and the combustion chamber 14 just after the exhaust port 28 is opened. The pressure of the ignition gases is thus partially reduced prior to charging of the auxiliary chambers 42.

In the illustrated construction (and as best seen in FIGS. 2 through 6), such means for establishing communication between the auxiliary chambers 42 and the combustion chamber 14 includes an auxiliary passage 44 associated with each auxiliary chamber 42. Each auxiliary passage 44 has upper and lower ports 46 and 48 axially spaced along the path of piston movement. Each upper port 46 has an upper edge 47 located at a distance C from the cylinder head end 18 (see FIG. 2), distance C being greater than distance A but less than distance B. Each lower port 48 has a lower edge 49 located at a distance D from the cylinder head end 18, which is greater than the distance C but still less than distance B (see FIG. 2).

The means also includes a port 43 for each auxiliary chamber 42. Each port 43 is axially spaced below the lower port 48 of the associated auxiliary passage 44. Each port 43 has an upper edge 50 located at a distance E from the cylinder head end 18 intermediate distances D and B (see FIG. 2).

Figure 2:
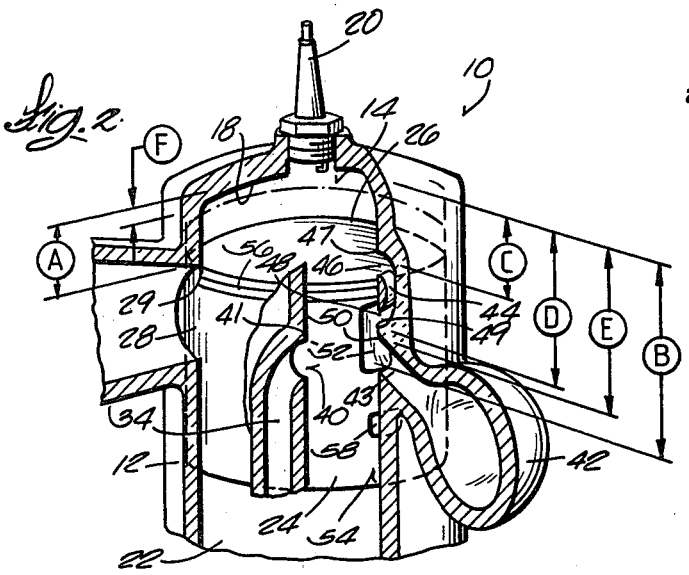
FIG. 2 is a perspective view, partially broken away, of one embodiment of a scavenging system applicable for use in connection with the engine illustrated in FIG. 1.
Figure 3:
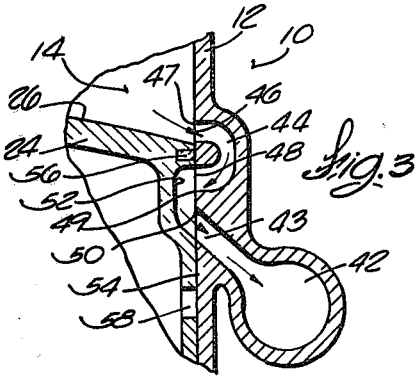
FIGS. 3, 4, 5, and 6 are a series of exploded side sectional views which sequentially illustrate the operation of a portion of the scavenging system shown in FIG. 2.

The means further include a series of nothes 52 or cutouts formed on the sidewall 54 of the piston 24 and associated with each auxiliary chamber 43. As can be seen in FIGS. 2 and 3, each notch 52 registers between the lower port 48 of the associated auxiliary passage and the associated auxiliary chamber port 43 when the head end 26 of the piston 24 is located between distances C and D from the cylinder head end 18. A path between the combustion chamber 14 and each auxiliary chamber 42 is thereby afforded during this time, through which path high pressure ignition gases flow (as shown by arrows in FIG. 3).

Figure 4:
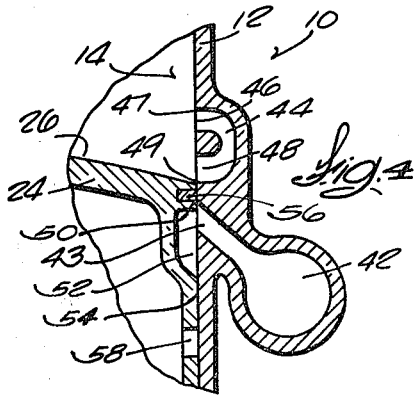

Means is also provided for isolating the high pressure ignition gases introduced into each auxiliary chamber 42 for a predetermined time interval. In the illustrated embodiment, this time interval is during piston travel from position D to position E. As is shown in FIG. 4, such means includes the port 43 associated with each auxiliary chamber and the associated notch 52 on the piston sidewall 54. More particularly, when the piston head end 26 is located between distance D and E from the cylinder head end 18, each notch 52 seals the associated auxiliary chamber port 43. The piston ring 56 further serves to isolate each auxiliary chamber 42 from the combustion chamber 14 during this period.

Figure 5:
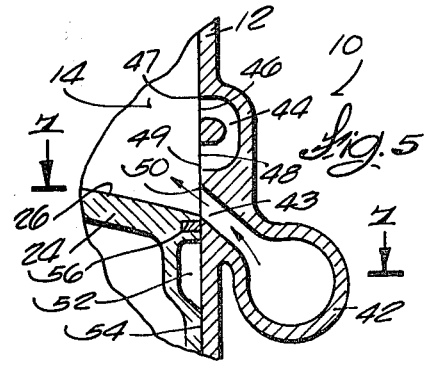
Figure 6:
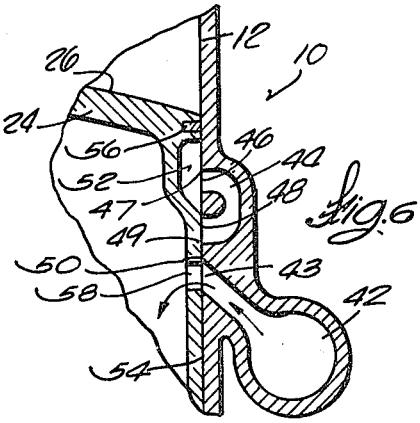

Means is also provided for reestablishing communication between the combustion chamber 14 and each auxiliary chamber 42 during piston travel between position E and the bottom dead center position. As is shown in FIG. 5, such means includes the port 43 which is associated with each auxiliary chamber 42 and which is opened to the combustion chamber 14 commencing when the piston head end 26 is located at position E. The high pressure ignition gases heretofore isolated in each auxiliary chamber 42 now flow into the combustion chamber 14 in the form of directional jets (as is shown by arrows in FIGS. 5 and 7).

As is shown in FIG. 7, each of the auxiliary chamber ports 43 are angularly positioned with respect to the exhaust port 28 so that the directional jets issue in a path which proceeds first away from the exhaust port 28 and thence across the combustion chamber 14 and out through the exhaust port 28.

While, in the illustrated embodiment, the auxiliary chamber ports 43 are all commonly located at distance E, it should be appreciated that the ports 43 can be spaced at progressively spaced intervals to stagger the issuance of the directional jets.

As the piston continues its downstroke, the upper transfer ports 40 are ultimately uncovered when the piston head end 26 is located at distance B from the cylinder head and 18 (as is generally shown in FIG. 1). The fuel-air mixture is thus introduced through the transfer passages 34 into the combustion chamber 14. Concurrently, the previously established directional jets of high pressure ignition gases continue to issue forth from the auxiliary chambers 42 in the path shown in FIG. 7 to influence the normal scavaging streams. The overall scavenging process is thus enhanced.

In the illustrated construction, means is also provided for establishing communication between each auxiliary chamber 42 and a source of relatively low pressure during piston movement between the top dead center position and a position in which the piston head end 26 is spaced from the cylinder head end 18 at a distance F, which is less than the distance A. This position of the piston 24 is shown in phantom lines in FIG. 2 and solid lines in FIG. 6.

In the illustrated construction (see FIGS. 2 and 6), the low pressure source comprises the crankcase 22. Communication is established by reason of registration during the desired period of each auxiliary chamber port 43 and an associated port 58 formed in the sidewall 54 of the piston 24. During this period, any residue gases in the auxiliary chambers 42 flow into the crankcase 22 to thereby evacuate each auxiliary chamber 42.

Reference is now made to the embodiment shown in FIGS. 8 through 11. Generally, like the first described embodiment, pressurized gases are used to influence the normal scavenging streams. However, instead of utilizing the series of closed auxiliary chambers 42 described in the first embodiment, an auxiliary transfer passage 60 is provided. This transfer passage 60 preferably extends arcuately and horizontally around the cylinder 16 (as is best shown in FIG. 11). Like the auxiliary chambers 42 in the first embodiment, the auxiliary transfer passage 60 is at one point charged with the pressured gases. However, unlike the auxiliary chambers 42, the auxiliary transfer passage 60 serves at a later point to supplement the flow of the new fuel-air mixture charge into the combustion chamber 14.

As in the first described embodiment, while any source of pressurized gas may be utilized, high pressure ignition gases existing in the combustion chamber 14 after ignition are utilized. Means is provided for isolating the auxiliary passage 60 from the crankcase 22 while establishing communication between the auxiliary transfer passage 60 and the combustion chamber 14 after ignition and shortly after opening of the exhaust port 28, but before opening of the transfer passages 34.

In the illustrated construction (see in particular FIGS. 8 and 11) such means includes circumferentially spaced ports 62 having upper edges 63 located at a distance G from the cylinder head end 18. As shown in FIG. 8, distance G is slightly greater than distance A, but less than distance B. As can be seen in FIG. 9, when the piston head end 26 is located at distance G, communication between the combustion chamber 14 and the auxiliary transfer passage 60 is afforded, but communication between the auxiliary transfer passage 60 and the crankcase 22 is blocked by the piston sidewall 54. The high pressure ignition gases present in the combustion chamber 14 at this time flow into and charge the auxiliary transfer passage 60 (as shown by arrows in FIG. 9).

As the piston 24 continues its downstroke toward its bottom dead center position, more and more of the exhaust port 28 is opened. At some point before the upper transfer ports 40 are opened (at distance B from the cylinder head end 18), the ongoing piston movement eventually creates a negative pulse in the combustion chamber 14. Since isolation of the auxiliary transfer passage 60 from the crankcase 22 and communication of the passage 60 with the combustion chamber 14 are maintained during this time (see FIG. 9), the high pressure ignition gases heretofore channelled into the auxiliary transfer passage 60 reverse their flow and proceed outwardly of the auxiliary transfer passage 60 back into the combustion chamber 14 in the form of directional jets (see FIG. 11). As in the first embodiment, and as shown by arrows in FIG. 11, the auxiliary transfer passage ports 62 are disposed at an angle away from the exhaust port 28 so that the scavenge loop commences first towards the rear of the combustion chamber 14 and thence across combustion chamber 14 and out through the exhaust port 28.

Means in the form of the heretofore described upper transfer ports 40 next establish communication between the primary transfer passages 34 and the combustion chamber 14 as the piston 24 travels between distance B and its bottom dead center postion. The fuel-air mixture flows through the primary transfer passages 34 from the crankcase 22 into the combustion chamber 14 under the influence of the previously established scavenge loop.

Means is provided for next establishing communication between the auxiliary transfer passage 60 and the crankcase 22. As can be seen in FIG. 10, the communication is established by the registration of a transfer port 64 associated with the auxiliary transfer passage 60 and a port 65 formed in the piston sidewall 54. The transfer port 64 which, in the illustrated embodiment, is located intermediate the two end ports 62 (see FIG. 11), registers with port 65 during piston movement between a position in which the piston head end 26 is spaced from the cylinder head end 18 at a distance H greater than distance B (see FIGS. 8 and 10) and the position at bottom dead center. During piston movement between the position H and bottom dead center, and in addition to the already existing communication between the combustion chamber 16 and the crankcase 22 through the primary transfer passages 34 during piston movement from position B to bottom dead center as already explained, the combustion chamber 26 in in communication with the crankcase 22 through the auxiliary transfer passage 60 to provide for supplemental fuel-air mixture flow from the crankcase 22 to the combustion chamber 26 in response to the presence of pressure in the crankcase 22.

As is shown in FIG. 8, means is provided for establishing communication between the auxiliary transfer passage 60 and a source of relatively low pressure during piston travel between the top dead center position and a position in which the piston head end 26 is spaced from the cylinder head end 18 at a distance I, which is less than the distance A. In the illustrated construction, the low pressure source comprises the crankcase 22. The piston 24 includes, along its lower edge, a notch 66 or cutout which registers with the transfer port 64 of the auxiliary transfer passage 60 to afford communication between the auxiliary transfer passage 60 and the crankcase 22 at the desired time. As a result, any gases present in the auxiliary transfer passage 60 are evacuated to the crankcase.

In the first two embodiments, the distances between the cylinder head end 18 and the opening of the various ports is to be maximized to the degree permissible, consistent with adequate exhaust and ample opportunity to supply the new charge of fuel-air mixture. By way of illustration, and referring principally to FIGS. 1, 2 and 8, as measured by degree of crankshaft rotation, the exhaust port 28 can begin to open (at distance A) at approximately 95° after top dead center.

Charging of the auxiliary chambers 42 (at distance C in the first embodiment) and the auxiliary transfer passage 60 (at distance G in the second embodiment) can begin after opening of the exhaust port 28 up to approximately 110° after top dead center, depending upon the magnitude of ignition gas pressure desired. Subsequent return of the high pressure ignition gases to the combustion chamber 14 (at distance E in the first embodiment and between distances G and H in the second embodiment) to establish a scavenge loop can begin almost immediately thereafter, with the subsequent opening of the upper transfer ports 40 (at distance B) occurring about 8° degrees after the establishment of the high pressure scavenge loop (or at approximately 118° after top dead center). In the second embodiment, the commencement of the supplemental fuel-air mixture flow through the auxiliary transfer passage 60 (at distance H) can take place shortly thereafter at approximately 122° after top dead center.

Furthermore, in the first and second embodiments, evacuation of the auxiliary chambers 42 (at distance F in the first embodiment) and the auxiliary transfer passage 60 (at distance I in the second embodiment) can occur during piston movement between approximately 40° before and 40° after its top dead center position.

Reference is now made to the third embodiment of the invention shown in FIGS. 12 and 13.

Generally, in this embodiment, low pressure regions in the combustion chamber 14 adversely affecting the stability of the scavenging loop are removed by the introduction of atmospheric fresh air.

Like the first two described embodiments, the engine 10 includes an exhaust port 28 having an upper edge 29 located at a distance A from the cylinder head end 18 (see FIG. 13). Also like the first two described embodiments, a series of fuel-air mixture transfer passages 34 are prvided having upper transfer ports 40 with upper edges 41 located at distance B from the cylinder head end 18 (see FIGS. 12 and 13).

However, unlike the first two described embodiments, one or more fresh air transfer passages 68 are provided. Three such air transfer passages 68 uniformly circumferentially spaced about the cylinder 16 are shown in the illustrated construction (see FIG. 12). Means is provided for selectively communicating each air transfer passage 68 with the atmosphere when the respective air transfer passage 68 is subject to low pressure. Fresh air is thus introduced into the affected air transfer passage 68.

In the disclosed construction, the means for selectively communicating the passages 68 with the combustion chamber 14 comprises an air entry port 70 associated with each air transfer passage 68 and a reed valve 72 which opens in response to low pressure in the respective air transfer passage 68 to afford inflow of fresh air from the atmosphere (as is shown in phantom lines in FIG. 13). The reed valve 72 is otherwise closed (as is shown in solid lines in FIGS. 12 and 13) to isolate associated air transfer passage from the atmosphere.

In this construction, means is provided for first establishing an incoming flow of fuel-air mixture from the crankcase 22 into the combustion chamber 14 through the heretofore described transfer passages 34. In the illustrated construction, the means comprises the upper transfer ports 40 which establish communication between the transfer passages 34 and the combustion chamber 14 during conditions of high pressure in the crankcase 22 and during piston travel between distance B and the bottom head center position.

In this construction, the upper transfer ports 40 are positioned away from the exhaust port 28 to minimize short circuiting loses and are angularly positioned toward the cylinder head end 18 (see FIG. 13) so that the incoming flow of fuel-air mixture is directed away from the piston 24 (as shown by arrows in FIG. 13). Additionally, the exhaust port 28 is arranged so that the cylinder pressure will drop to nearly atmospheric during the period between when the exhaust port 28 opens (at distance A) and when the upper transfer ports 40 open (at distance B).

In this construction, means is also provided for next introducing fresh air through any one of the air transfer passages 68 into low pressure regions which can develop in the combustion chamber 14 between the piston head end 26 and the incoming, upwardly directed flow of fuel-air mixture. In the illustrated construction, such means comprises an air inlet port 74 associated with each air transfer passage 68. As can be seen in FIG. 13, each port 74 has upper edge 75 located from the cylinder head end 18 at a distance J, which is greater than the distance B.

By virtue of this construction, as low pressure regions develop in the combustion chamber 14 during the scavenging process, one or more of the reed valves 72 open to permit the inflow of fresh air from the atmosphere into the combustion chamber 14. Such low pressure regions are thereby eliminated, and the reed valves 72 thereafter close to prevent further inflow of fresh air into the air transfer passages 68. The stability of the scavenge loop is enhanced.

The features of the third embodiment can be used alone or in combination with either of the first or second described embodiments to stabilize the overall scavenging process.

While, in the three illustrated embodiments, all engines 10 are piston ported, other arrangements can be employed to provide the desired communication at the desired times. For example, a cam shaft operated valve system could be employed. Alternately, a rotary valve could be employed to provide the various sequential communications.

Furthermore, while the invention has general applicability to spark ignition piston ported engines, (i.e. piston ported engines other than diesel piston ported engines), it is equally applicable to cross scavenged and loop scavenged engines.

It is believed that the method of the invention is clearly apparent from the foregoing description of the operation of the engine.

Various of the features of the invention are set forth in the following claims.

I claim:

1. A method of operating an internal combustion engine including a combustion chamber, an auxiliary chamber, a piston movable relative to the combustion chamber between top dead center and bottom dead center positions and relative to first, second, third, and fourth positions respectively spaced from the top dead center position at respectively greater distances, a source of a pressurized fuel-air mixture, and a source of a pressurized gas, said method comprising the steps of establishing communication between the auxiliary chamber and the source of pressurized gas during piston travel from the first to the second position so that pressurized gas is introduced into the auxiliary chamber, isolating the pressurized gas introduced into the auxiliary chamber during piston travel from the second position to the third position, establishing communication between the auxiliary chamber and the combustion chamber during piston travel between the third position and the bottom dead center position so that pressurized gas supplied to the auxiliary chamber flows into the combustion chamber, and establishing communication between the combustion chamber and the source of pressurized fuel-air mixture during piston travel between the fourth position and the bottom dead center position so that the pressurized fuel-air mixture flows into the combustion chamber from the fuel-air mixture source.

2. A method of operating an internal combustion engine according to claim 1 wherein the engine further includes a source of low pressure, and wherein the method further includes the step of establishing communication between the auxiliary chamber and the source of low pressure during piston travel between the top dead center position and the first position so that the auxiliary chamber is evacuated, and wherein said step of establishing communication between the auxiliary chamber and the source of pressurized gas includes terminating the communication between the auxiliary chamber and the source of low pressure while establishing communication between the auxiliary chamber and the source of pressurized gas during piston travel from the first position to the second position so that the pressurized gas is introduced into the evacuated auxiliary chamber.

3. A method of operating a two-stroke internal combustion engine including a cylinder extending from a crankcase, an auxiliary chamber, a piston movable relative to the cylinder between top dead center and bottom dead center positions and relative to first, second, third, and fourth positions respectively spaced from the top dead center position at respectively greater distances, whereby the crankcase is subject to cyclical conditions of relatively high and low pressure, means for supplying fuel-air mixture to the crankcase when the crankcase is subject to low pressure, a transfer passage communicating with the crankcase and communicable with the cylinder in response to piston movement, and means for igniting the fuel-air mixture in the cylinder when the piston is located generally adjacent to the top dead center position, thereby creating within the cylinder above the piston high pressure ignition gases, said method comprising the steps of establishing communication between the auxiliary chamber and the cylinder after ignition of the fuel-air mixture and during piston travel from the first position to the second position so that the high pressure ignition gases are introduced into the auxiliary chamber, isolating the high pressure ignition gases introduced into the auxiliary chamber during piston travel from the second position to the third position, reestablishing communication between the cylinder and the auxiliary chamber during piston travel between the third position and the bottom dead center position so that the high pressure ignition gases supplied to the auxiliary chamber flow into the cylinder, and establishing communication between the cylinder and the transfer passage during conditions of high pressure in the crankcase and during piston travel between the fourth position and the bottom dead center position so that the fuel-air mixture flows through the transfer passage into the cylinder.

4. A method of operating a two-stroke internal combustion engine according to claim 3 and further including the step of establishing communication between the auxiliary chamber and the crankcase during conditions of low pressure in the crankcase and during piston travel between the top dead center position and the first position so that the auxiliary chamber is evacuated, and wherein said step of establishing communication between the auxiliary chamber and the cylinder during piston travel from the first position to the second position includes terminating the communication between the auxiliary chamber and the crankcase while establishing communication between the auxiliary chamber and the cylinder during piston travel from the first position to the second position so that high pressure ignition gases within the cylinder are introduced into the evacuated auxiliary chamber.

5. An internal combustion engine including a combustion chamber, an auxiliary chamber, a piston movable relative to said combustion chamber between top dead center and bottom dead center positions and relative to first, second, third, and fourth positions respectively spaced from said top dead center position at respectively greater distances, a source of a pressurized fuel-air mixture, a source of a pressurized gas, means for establishing communication between said auxiliary chamber and said source of pressurized gas during piston travel from said first to said second position, whereby pressurized gas is introduced into said auxiliary chamber, means for isolating the pressurized gas introduced into said auxiliary chamber during piston travel from said second position to said third position, means for establishing communication between said auxiliary chamber and said combustion chamber during piston travel between said third position and said bottom dead center position, whereby the pressurized gas supplied to said auxiliary chamber flows into said combustion chamber, and means for establishing communication between said combustion chamber and said source of pressurized fuel-air mixture during piston travel between said fourth position and said bottom dead center position, whereby the pressurized fuel-air mixture flows into combustion chamber from said fuel-air mixture source.

6. An internal combustion engine according to claim 5 and further including a source of low pressure and means for establishing communication between said auxiliary chamber and said source of low pressure during piston travel between said top dead center position and said first position, whereby said auxiliary chamber is evacuated, and wherein said means for establishing communication between said auxiliary chamber and said source of pressurized gas includes means for terminating the communication between said auxiliary chamber and said source of low pressure while establishing communication between said auxiliary chamber and said source of pressurized gas during piston travel from said first position to said second position, whereby the pressurized gas is introduced into said evacuated auxiliary chamber.

7. A two-stroke internal combustion engine comprising a cylinder, a crankcase extending from said cylinder, an auxiliary chamber, a piston movable relative to said cylinder between top dead center and bottom dead center positions and relative to first, second, third, and fourth positions respectively spaced from said top dead center position at respectively greater distances, whereby said crankcase is subject to cyclical conditions of relatively high pressure and low pressure, means for supplying a fuel-air mixture to said crankcase when said crankcase is subject to low pressure, a transfer passage communicating with said crankcase and communicable with said cylinder in response to said piston movement, means for igniting said fuel-air mixture in said cylinder when said piston is located generally adjacent to said top dead center position, whereby high pressure ignition gases are created within said cylinder above said piston, means for establishing communication between said auxiliary chamber and said cylinder during piston travel from said first position to said second position, whereby the high pressure ignition gases are introduced into said auxiliary chamber, means for isolating the high pressure ignition gases introduced into said auxiliary chamber during piston travel from said second position to said third position, means for reestablishing communication between said cylinder and said auxiliary chamber during piston travel between said third position and said bottom dead center position, whereby the high pressure ignition gases supplied to said auxiliary chamber flow into said cylinder, and means for establishing communication between said cylinder and said transfer passage during conditions of high pressure in said crankcase and during piston travel between said fourth position and said bottom dead center position, whereby the fuel-air mixture flows through said transfer passage into said cylinder.

8. A two-stroke internal combustion engine according to claim 7 and further including means for establishing communication between said auxiliary chamber and said crankcase during conditions of low pressure in said crankcase and during piston travel between said top dead center position and said first position, whereby said auxiliary chamber is evacuated, and wherein said means for establishing communication between said auxiliary chamber and said cylinder during piston travel from said first position to said second position includes means for terminating the communication between said auxiliary chamber and said crankcase while establishing communication between said auxiliary chamber and said cylinder during piston travel from said first position to said second position, whereby the high pressure ignition gases within said cylinder are introduced into said evacuated auxiliary chamber.

9. A two-stroke internal combustion engine according to claim 8 and further including an exhaust port communicating with said cylinder and means for directing the flow of said high pressure ignition gases supplied by said auxiliary chamber into said cylinder in a path away from said exhaust port.

10. A two-stroke internal combustion engine according to claim 8 wherein said cylinder includes a sidewall, and wherein said means for sequentially establishing, isolating and reestablishing communication between said auxiliary chamber and said cylinder during piston travel from said first position to said bottom dead center position through said second and third positions includes an auxiliary transfer passage having upper and lower ports in said cylinder sidewall axially spaced along the path of piston movement, a port in said cylinder sidewall communicating with said auxiliary chamber and axially spaced below said lower port of said auxiliary transfer passage, and a notch in said piston registering with said lower port of said auxiliary transfer passage and said auxiliary chamber port during piston travel from said first position to said second position and located below said lower port of said auxiliary transfer passage and covering said auxiliary chamber port during piston travel from said second position to said third position.

11. A two-stroke internal combustion engine according to claim 10 and wherein said means for establishing communication between said auxiliary chamber and said crankcase includes a port in said piston registering with said auxiliary chamber passage port.

* * * * *